US008065899B2

(12) United States Patent
Frustie

(10) Patent No.: US 8,065,899 B2
(45) Date of Patent: Nov. 29, 2011

(54) ADVANCED FEED DEVICE FOR A SUPERPLASTIC PRESS FORMING SYSTEM

(75) Inventor: Valerie Frustie, Toulouse (FR)

(73) Assignee: Airbus France, Toulouse (FR)

( * ) Notice: Subject to any disclaimer, the term of this patent is extended or adjusted under 35 U.S.C. 154(b) by 316 days.

(21) Appl. No.: 12/419,673

(22) Filed: Apr. 7, 2009

(65) Prior Publication Data

US 2009/0282889 A1 Nov. 19, 2009

(30) Foreign Application Priority Data

Apr. 8, 2008 (FR) ..... 08 52351

(51) Int. Cl.
*B21B 45/02* (2006.01)
*B21D 37/16* (2006.01)

(52) U.S. Cl. ..... 72/60; 72/342.8; 72/364; 72/379.2; 72/709

(58) Field of Classification Search ..... 72/57, 60, 72/342.96, 364, 379.2, 709; 228/2.1, 114, 228/157, 181, 190, 203
See application file for complete search history.

(56) References Cited

U.S. PATENT DOCUMENTS

| | | | | |
|---|---|---|---|---|
| 5,113,681 | A * | 5/1992 | Guesnon et al. | 72/53 |
| 7,165,435 | B1 * | 1/2007 | Schroth et al. | 72/364 |
| 7,199,334 | B2 * | 4/2007 | Friedman et al. | 72/361 |
| 7,284,402 | B2 * | 10/2007 | Friedman et al. | 72/60 |
| 7,416,105 | B2 * | 8/2008 | Pitt et al. | 72/60 |
| 2006/0237420 | A1 | 10/2006 | Friedman et al. | |
| 2006/0260373 | A1 | 11/2006 | Allor et al. | |

FOREIGN PATENT DOCUMENTS

| | | |
|---|---|---|
| FR | 2 408 403 A | 6/1979 |
| FR | 2 739 832 A | 4/1997 |
| WO | 02/22286 A | 3/2002 |

* cited by examiner

*Primary Examiner* — David Jones
(74) *Attorney, Agent, or Firm* — Perman & Green, LLP

(57) ABSTRACT

A feed device for a superplastic press-forming press has a slide that moves vertically and a base between which is held a tool having a cover and a bottom die enclosing a forming tool, which includes at least one heating shuttle to transport the bottom die, equipped with the forming tool and a cover, with the heating shuttle adapted to complete the press and constitute the base of the press during a hot-press forming operation.

10 Claims, 5 Drawing Sheets

ADVANCED FEED DEVICE FOR A SUPERPLASTIC PRESS FORMING SYSTEM

BACKGROUND

1. Field

The disclosed embodiments concern an improvement in superplastic press forming systems, particularly an advanced feed device for such a press forming system.

2. Brief Description of Related Developments

Superplastic press forming SPF is a method of forming strip or sheet-metal-based pieces to make complex, resistant light-weight pieces with very large extensions.

It is based on heating metal strips or sheets placed in a forming tool with a cavity and applying pressure with gas injected into the cavity of the tool to push the piece against the wall of the cavity of the forming tool.

For aluminum-based alloys, the temperature of the cavity must reach a value of 450° C. to 500° C. and for titanium-based alloys, the temperature must commonly reach 890° C. to 920° C.

An example of pressing and hot pressing by superplastic deformation is known from document US 2006/0260373 A1 and an example of a complex piece made by such a process is known from FR 2 739 832 A1.

A conventional press for forming simple sheet metal is sketched in FIG. 1 of the prior art.

The press includes a hot press slide 1, a cover 2, forming the top part of the cavity that holds and forms the piece 3, a forming tool 4 that fits into a bottom die 5 and a heating support forming the base 6 of the press.

The bottom part of the cover 2 and the top part of the forming tool form two hot-forming die halves between which the sheet metal 3 being formed is inserted.

A pressurized gas G is inserted into the cavity through one or more conduits 6 to apply pressure $P_G$ to the sheet metal 3 and push it against the forming tool 4.

When the piece is being formed, mechanical pressure $P_M$ is applied to the slide of the press to clamp the edge of the piece and seal the cavity.

One of the problems with the process is that the time for heating the various parts of the tool is very long, commonly two days to reach a high uniform temperature for the tool components, so the process can be used.

This is not really a problem when parts are made in large series with the same shape, since this heating time similar to the start-up time for the process is negligible compared to the time the tool is used.

Moreover, to increase the pace of the press, it is known how to preheat the pieces outside the press to prevent them from spending too long in transit to the press.

In this context, document US 2006/0237420 A1 describes a device for heating and transferring parts that makes it possible to feed the press with preheated parts.

This device has a transport shuttle for the metal strips or sheets intended to make the piece and means of heating the metal strips.

On the other hand, in the case of small series of pieces with different shapes, preheating the metal strips or sheets is not enough to optimize the yield of the process and, notably, the time necessary for preheating the die half of the forming tool becomes a disadvantage compared to the time for forming the pieces.

In addition, in such case, there is a need to let the forming tools cool to replace them, which adds to the time that the press is not available.

The heating and cooling phases in particular can represent up to 30% of the load on the press for small and medium-sized series.

SUMMARY

The purpose of the disclosed embodiments is to reduce the time when the press is not available between forming cycles for pieces with different shapes by superplastic forming by proposing to heat and cool the tools in concurrent operating time.

To do so, it provides a feed device for a superplastic hot-forming press that has a slide that moves vertically and a base between which there is a tool with a cover and a bottom die enclosing a forming tool, having at least one heating transport shuttle for the bottom die, equipped with a forming tool, and a cover; said heating shuttle is adapted to complete the press and constitute the base of said press during a hot-pressing operation; the device also has a track for the shuttle extending under the press and continuing outside the press from at least one side of it into at least one shuttle parking area.

The aspects of the disclosed embodiments also provide a process for feeding a superplastic forming press with a feed device that includes at least one hot transport shuttle for the bottom die, which holds a forming tool; said heating shuttle is adapted to supplement the press and constitute the base of said press during a hot-pressing operation; the feed device has a shuttle track extending under the press and continuing to the outside of the press into at least two shuttle parking areas, where, during production cycles, at least one first shuttle is placed in a parking area, and equipped with a first forming tool for making initial pieces; the forming tool is preheated in the first shuttle, while a second shuttle equipped with a second forming tool for making second pieces completes the press to make said second pieces.

More specifically, the cooling and/or tool-changing and/or preheating operations for the first shuttle are done in concurrent operating time in relation to the pressing process carried out on the press equipped with a second shuttle.

BRIEF DESCRIPTION OF THE DRAWINGS

Other features and advantages of the disclosed embodiments will be apparent from reading the following description of non-limiting examples of embodiment with reference to the drawings.

DETAILED DESCRIPTION OF THE DISCLOSED EMBODIMENTS

Figure 1:
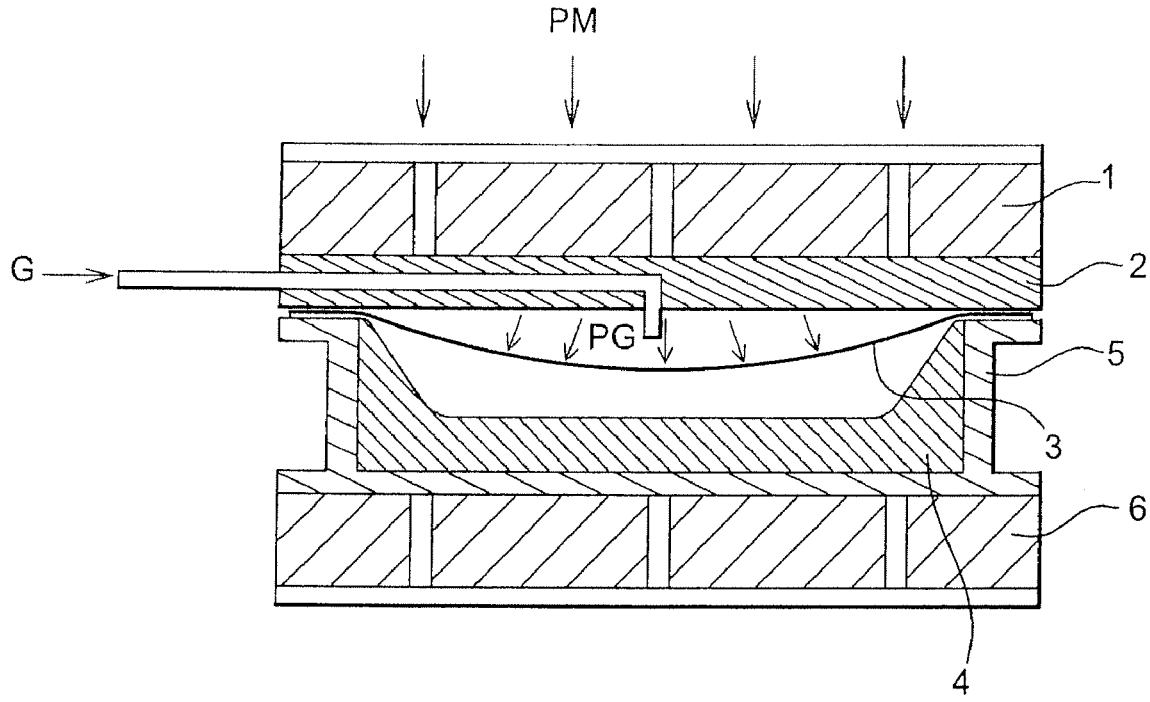
Fig. 1 PRIOR ART
FIG. 1 shows a schematic sectional side view of a hot-forming press from the prior art.

The hot-forming press in FIG. 1 is a traditional press described earlier and the sheet metal and parts formed are loaded and unloaded by raising the slide, which brings the cover 2 along as it moves.

In the case of a traditional press, the heat support forming the base 6 of the press is fixed, and the tool 4 is changed by opening the press after it cools; cooling and tool-changing can take several days, during which the press is not available.

Figure 2:
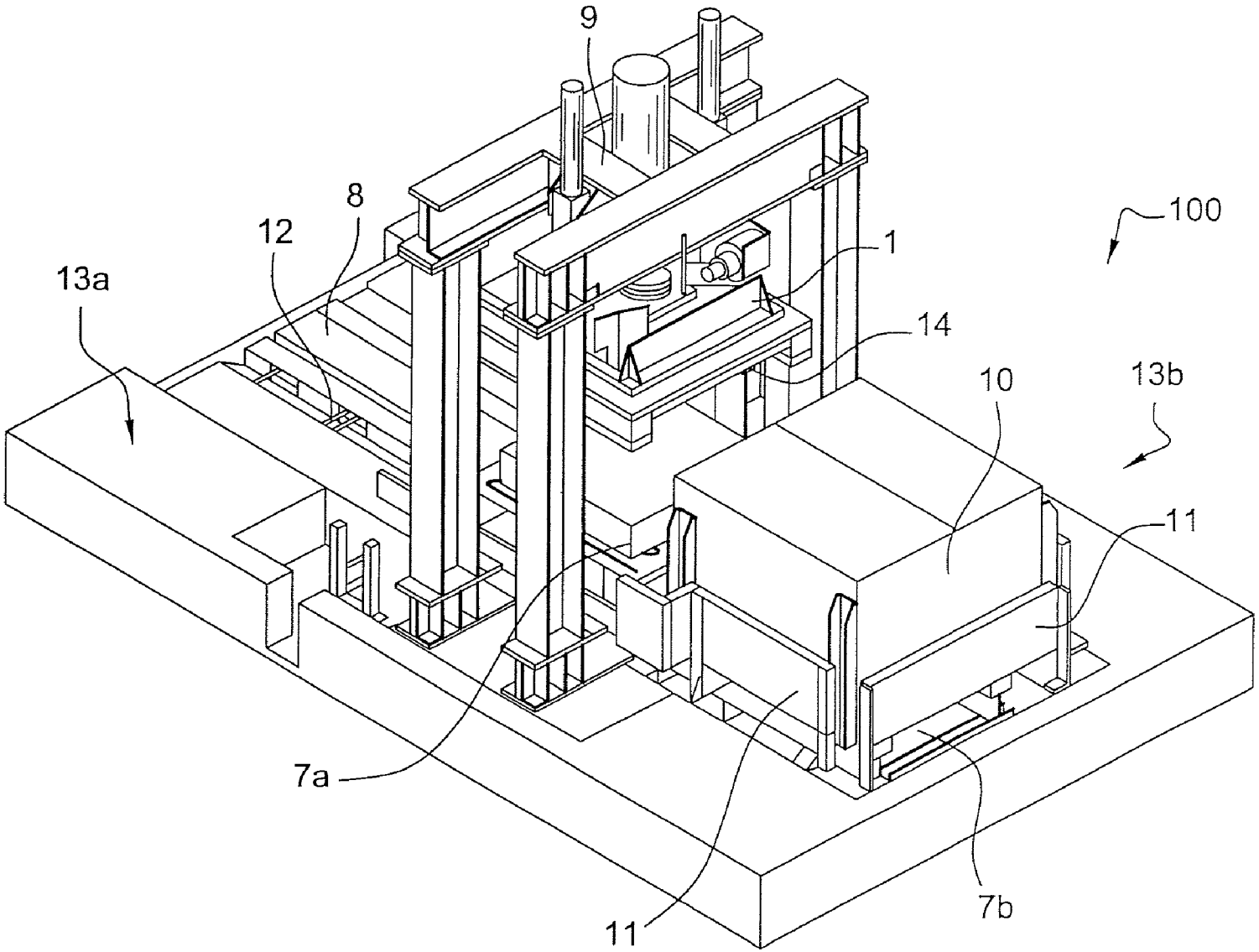
FIG. 2 shows a perspective view of a hot-forming press and the feed device.

The press 100 as disclosed herein is shown in general in FIG. 2.

It includes a slide 1 that moves vertically and is held by a frame 9, as known from the prior art.

According to the aspects of the disclosed embodiments, at least one heating shuttle 7*a*, 7*b* is adapted to complete the press and constitutes the base 6 of it during a hot-pressing operation.

In the embodiment in FIG. 2, two shuttles 7*a* and 7*b* are used alternately with the press 100, and a first shuttle 7*a* is shown under the press, while a second shuttle 7*b* is being preheated under a heating cocoon 10.

These shuttles move on a track 8 that extends under the press and continues to the outside of the press on each side of the press, which defines the shuttle parking areas 13*a*, 13*b*.

Figure 3:
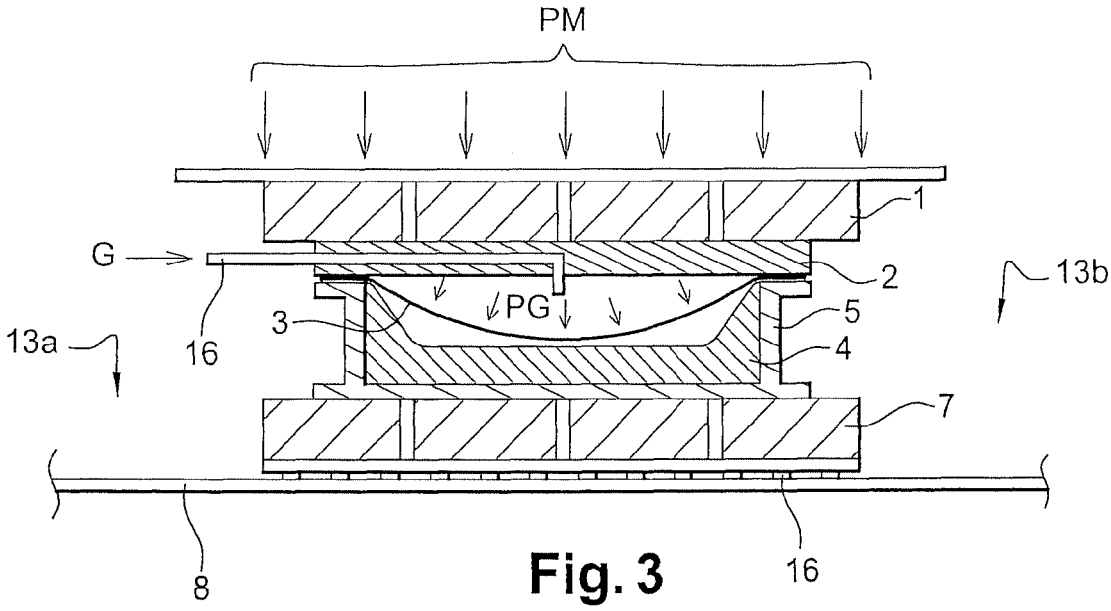
FIG. 3 shows a schematic side view of a hot-forming press and the feed device.

As shown in FIG. 3, the heating shuttle 7 is a transport shuttle for the bottom die 5, equipped with a forming tool 4 and a transport tool with a cover 2.

The cover is integral with the slide of the press when the shuttle is positioned in the press.

Still in FIG. 3, when the cover is integral with the slide 1, like presses of the prior art, it receives an arrival of gas G through tubing 16 to form the piece 3.

Back to FIG. 2, when the shuttles are out of the press, they are taken to the parking areas 13*a*, 13*b*, with area 13*a* in FIG. 1 being free of its shuttle 7*a*, which makes it possible to see the connection 12 of a shuttle heating device, while area 13*b* takes its shuttle 7*b*, which is equipped with an insulating cocoon 10.

This cocoon is an insulating bell that can include heating elements or be passive.

The insulating cocoon 10 placed at least near said parking area makes it possible to cover the shuttle 7*a*, 7*b*, 7*c* equipped with the forming tool 4 and cover 2 to perform an operation to preheat the tool and the shuttle outside of the press.

The parking area 13*b* is also shown with elements of thermal barriers 11 surrounding the shuttle over at least three sides, the insulating cocoons, thermal barriers 11 and heating device 12 thus constituting a shuttle heating device near said parking area.

Still on FIG. 3, the shuttle 7 is shown equipped with rollers 16 that allow it to roll over the track 8.

Figure 4:
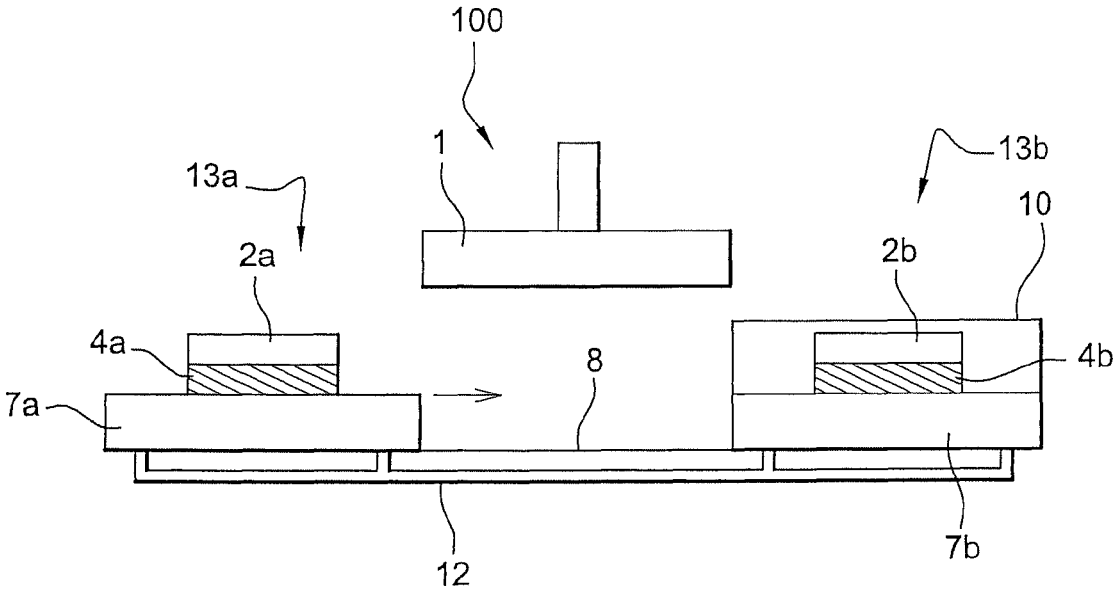
FIG. 4 shows a schematic view of the principle of the feed device.

FIG. 4 is a schematic side view showing a shuttle 7*b* equipped with a first tool 2*b*, 4*b* being preheated under its insulating cocoon 10 in a parking area 13*b* and on one side of the press, while a shuttle 7*a* with its cocoon removed is moved from the parking area 13*a* to the press to be positioned under the slide 1.

The shuttles move separately, and the heating control for the shuttles is separate.

Figure 5:
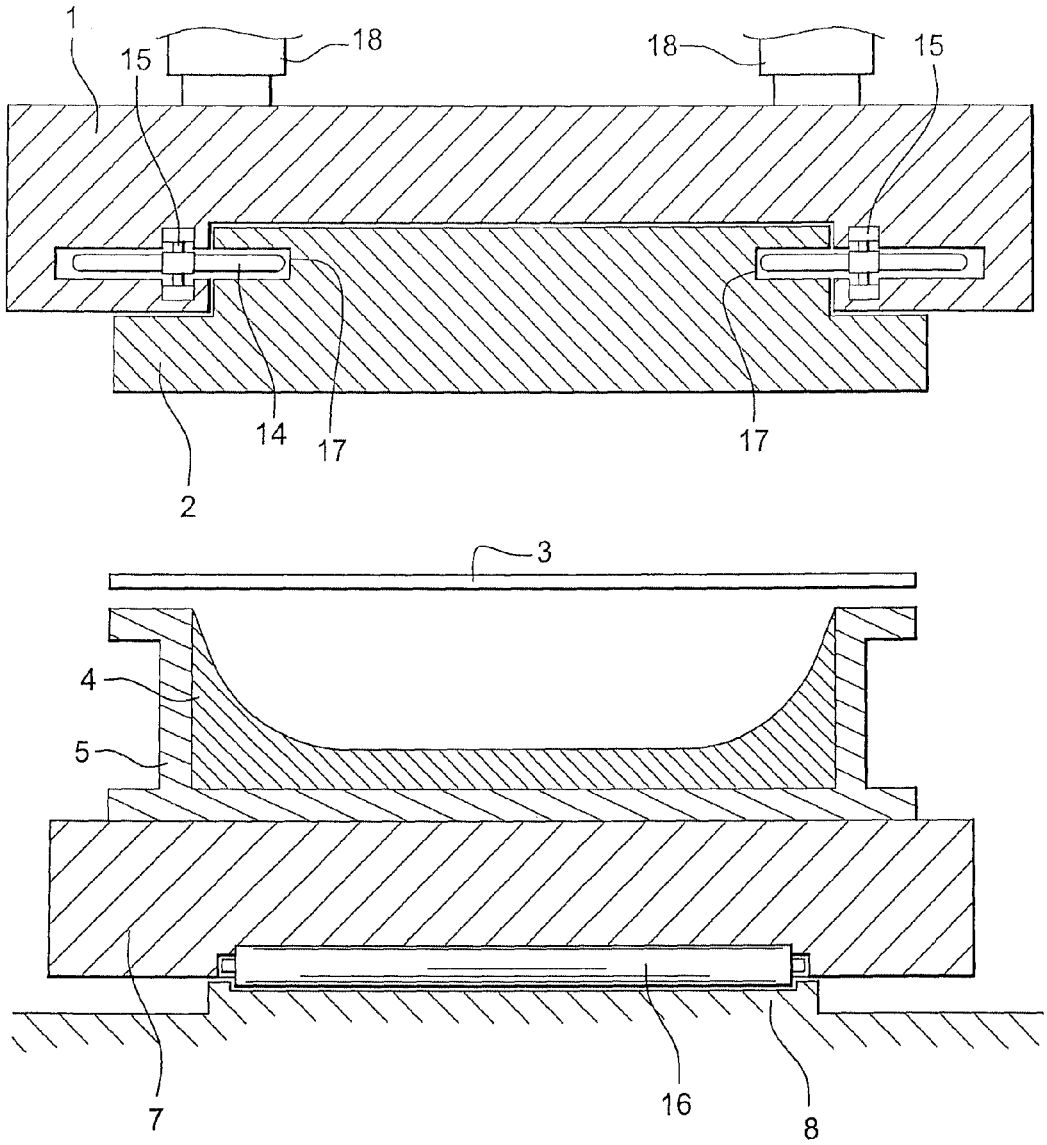
FIG. 5 shows a schematic sectional view of the press in FIG. 2 open, when seen from the front.

FIG. 5 shows a schematic front view of the press in the open position for loading a piece of sheet metal 3.

This figure shows the device for hooking the cover 2 under the slide 1.

To hook on the cover, the slide 1 is provided with retractable means 14 of grasping and holding the cover 2.

These retractable means make it possible, in the retracted position, to lower the slide over the cover once the shuttle is positioned in the press to put the slide under the cover.

Once the slide is positioned under the cover, the means of grasping and holding 14 are deployed in the grooves or casings 17 made in the cover so that the cover, which has been made integral with the slide, can be raised and lowered by the slide.

According to the example in FIG. 5, the retractable means 14 are support shoes that move in rotation on axes 15 perpendicular to the direction of insertion/extraction of the cover in the slide.

The system for hooking the cover to the slide can be made with hooking and grasping means in the form of one or more support shoes controlled by one or more rotary systems driven by a reducing gear that makes it possible to leave free the whole width of the tool when the shuttle is translated into the press part.

When the shuttle is in position, the motor makes it possible to rotate the cover support shoes so that they are inserted into their casings in the cover and thus make the cover integral with the slide.

Translation of the slide upward makes it possible to raise the cover and disengage the forming tool to insert the pieces to be made and take out the pieces that are finished.

This figure shows a schematic embodiment of the track 8 and a roller 16 that make it possible to move the shuttle in and out of the press 100 and jacks 18 for activating the slide 1.

Figure 6A:
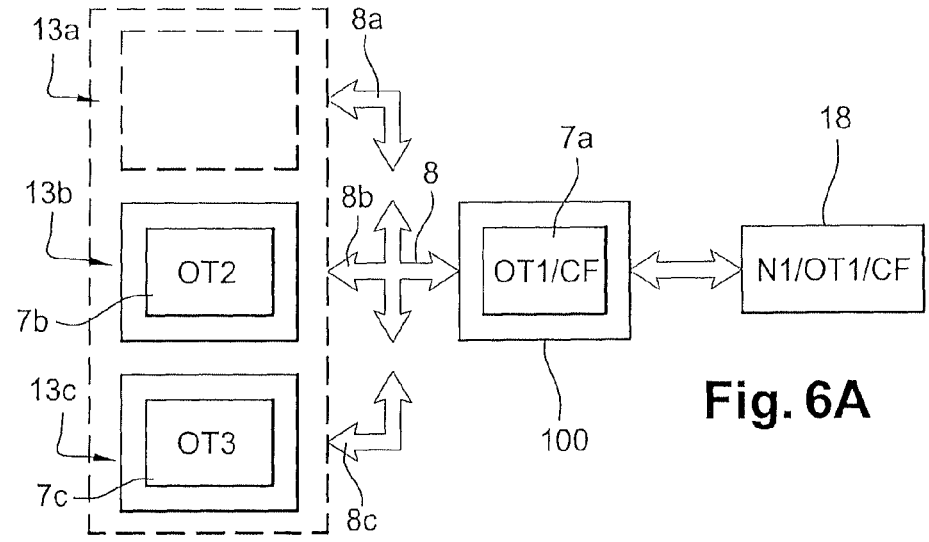
FIGS. 6A to 6C are diagrams showing a sequence of campaigns forming pieces using the process.
Figure 6B:
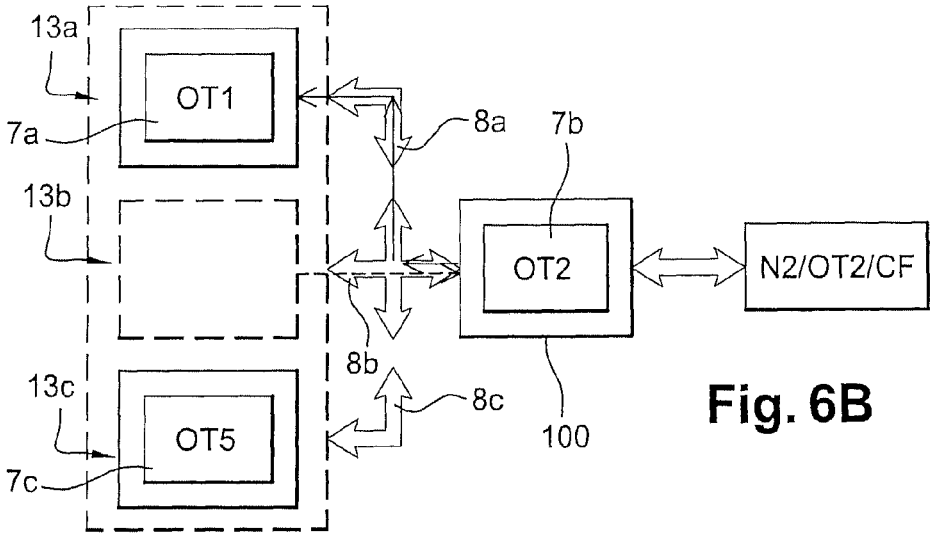
Figure 6C:
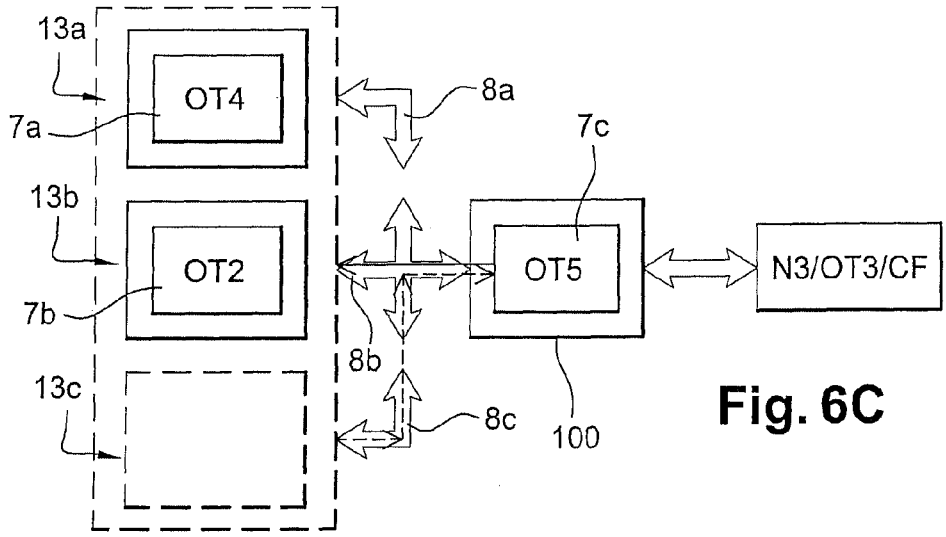

FIGS. 6A to 6C show an example of a preferred embodiment in which the track 8 has a plurality of branches 8*a*, 8*b*, 8*c*, each with a parking area 13*a*, 13*b*, 13*c* to take a plurality of shuttles 7*a*, 7*b*, 7*c*, which can move alternately in and out of the press.

In the case of FIGS. 6*a* to 6*c*, for which the device has three heating shuttles 7*a*, 7*b*, 7*c* adapted to complete the press and constitute the base 6 of said press during a hot-pressing operation, the feed device also has a track 8 for the shuttles that extends under the press and continues outside the press along a plurality of branches 8*a*, 8*b*, 8*c* in at least three shuttle parking areas 13*a*, 13*b*, 13*c*.

The process is in this configuration so that during a production cycle for pieces, a first shuttle, equipped with a first forming tool, completes the press to make the first pieces; a second shuttle equipped with a second tool to make second pieces is located in the first parking area and is being preheated; a third shuttle is in the second parking area and is cooling to allow a tool change; a third parking area is free to take the first shuttle at the end of the production cycle for the first pieces and allows said second and third shuttles to take its place; during the manufacturing of the pieces, the first, second and third shuttles in turn act as the base of the press 100 to fabricate series of pieces for the tools held by each of the shuttles.

The device shown here has three heating shuttles 7*a*, 7*b*, 7*c* for transporting tools OT1 to OT5, each having a die that holds a forming tool 4.

The heating shuffles are each adapted to complete the press and constitute the base 6 of said press during a hot-pressing operation.

The feed device, which has a track 8 for the shuttle, extends under the press and continues on the outside of the press into three shuttle parking areas 13*a*, 13*b*, 13*c* along three branches 8*a*, 8*b*, 8*c*.

In FIG. 6A, a first shuttle 7*a* equipped with a tool OT1 is in the press 100, while a second shuttle 7*b* equipped with a tool OT2 is being pre-heated in a parking area 13*b* and a third shuttle 7*c* equipped with a tool OT3 is in the process of cooling.

During pressing with tool OT1, the shuttle 7*a* can move into a loading/unloading zone 18 after each piece is made and make round trips between the press and this loading/unloading zone.

When the series of pieces to be made with tool OT1 is finished, it goes to the step in FIG. 6B in which the first shuttle 7*a* is brought back into its parking area 13*a* and replaced at the press 100 with the second shuttle 7*b* equipped with tool OT2.

During this time, the third shuttle 7*c*, which has cooled, is equipped with tool OT5 and heated up.

The piece-forming operations are then conducted with tool OT2, while the first shuttle is in the process of cooling.

Finally, FIG. 6C shows a third step in the forming cycle for pieces for which the first shuttle 7*a*, having cooled, receives a new tool OT4 and is heated up; the second shuttle 7*b* equipped with its tool OT2 is brought back into its parking area 13*b* to be cooled, and the third shuttle 7*c* is directed toward the press 100 to allow pieces to be made with tool OT5.

FIG. 4 shows the process in the disclosed embodiments adapted to a press that takes two shuttles alternately and for which, during the production cycle for the pieces, at least one first shuttle 7*b* is positioned in a parking area; it is equipped with a first forming tool 2*a*, 4*a* to make the first pieces; the forming tool is pre-heated in the first shuttle, while a second shuttle 7*a* equipped with a second forming tool 2*b*, 4*b* for making the second pieces completes the press to make said second pieces.

According to this process, the cooling and/or tool change and/or pre-heating operations for the first shuttle are done in concurrent operating time in relation to the pressing process done on the press equipped with a second shuttle.

As an example, for campaigns to make around fifteen pieces with tooling lasting three days, using three shuttles makes it possible to have totally concurrent operating times for cooling 2 days, tool changing 1 day and heating 2 days for each shuttle.

The aspects of the disclosed embodiments are not limited to the examples shown and, notably, for a shop making many small series, the number of shuttles can be increased, while remaining within the field of the claims, which alone define the scope of the disclosed embodiments.

The invention claimed is:

1. A feeding device for feeding a superplastic forming press having a slide that moves vertically and a base between which are located a cover and a bottom die enclosing a forming tool, said feeding device comprising:

at least one heating shuttle for carrying said bottom die enclosing said forming tool, the bottom die equipped with said cover; wherein said base comprises said heating shuttle during a hot-pressing operation; and a track, for carrying said shuttle, said track extending from under said press to adjacent at least one side of said press, the track adjacent at least one side of said press defining at least one parking area for said shuttle.

2. The feeding device of claim 1, wherein said device includes a heating device in said parking area for heating said shuttle.

3. The feeding device of claim 1, comprising, at least in the parking area, an insulating cocoon adapted for covering the shuttle carrying said bottom die enclosing said forming tool and equipped with said cover.

4. The feeding device of claim 1, wherein said parking area includes thermal barrier elements.

5. The device of claim 1, wherein said track includes a plurality of branches each provided with an additional parking area for parking one or more additional shuttles which travel alternately in and out of the press.

6. A press having a feed device according to claim 1, wherein said slide is provided with retractable means for grasping and holding said cover.

7. The press of claim 6, wherein said slides comprises axes and wherein said retractable means comprise support shoes adapted to rotate around said axes perpendicular to a direction of insertion/extraction of the cover in the slide.

8. A process for feeding a superplastic hot-forming press having a feed device with at least one heating shuttle to transport a die holding a forming tool; said base of said press comprising said heating shuttle during a hot-pressing operation; said feed device having a track for carrying said shuttle, said track extending from under said press to adjacent at least two sides of said press, each track adjacent each side of said press defining a shuttle parking area, wherein said process comprises, during production cycles of parts to be made:

positioning at least one first shuttle in a parking area;

providing said first shuttle with a first forming tool for making first parts; and pre-heating the first forming tool in said first shuttle, while a second shuttle provided with a second forming tool for making second parts is positioned under said press to make said second parts.

9. A process for feeding a superplastic hot-forming press having a feed device with a plurality of heating shuttles for transporting dies holding forming tools; a base of said press comprising at least one of the plurality of heating shuttles during a hot-pressing operation; said feed device including a shuttle track extending from under said press to adjacent at least one side of the press along a plurality of branches, said shuttle track branches defining at least three heating shuttle parking areas, wherein said process comprises, during a production cycle of parts positioning a first heating shuttle, equipped with a first forming tool, under the press to make first parts, locating a second heating shuttle, equipped with a second forming tool to make second parts, in a first heating shuttle parking area and pre-heating said second heating shuttle;

cooling a third heating shuttle in a second heating shuttle parking area to permit a tool change; and providing a third heating shuttle parking area to receive the first heating shuttle at an end of the production cycle of first parts in order to position said second and third heating shuttles under said press.

10. The process for feeding a superplastic hot-forming press of claim 9, wherein cooling and/or tool-changing and/or pre-heating operations of a one of the first, second, and third heating shuttles are done in concurrent operating time in relation to a pressing process done on another of the first, second, and third heating shuttles.

* * * * *

UNITED STATES PATENT AND TRADEMARK OFFICE

CERTIFICATE OF CORRECTION

PATENT NO. : 8,065,899 B2
APPLICATION NO. : 12/419673
DATED : November 29, 2011
INVENTOR(S) : Valerie Frustie It is certified that error appears in the above-identified patent and that said Letters Patent is hereby corrected as shown below:

Column 6, line 3 (Claim 5, line 1) delete "device" and insert --feeding device-- therefor.

Column 6, line 53 (Claim 10, line 3) delete "of a" and insert --of-- therefor.

Signed and Sealed this
Twenty-first Day of February, 2012

David J. Kappos

David J. Kappos
*Director of the United States Patent and Trademark Office*